United States Patent [19]

Wright

[11] 4,405,395

[45] Sep. 20, 1983

[54] REINFORCED STRUCTURES

[75] Inventor: Anthony R. Wright, Nuneaton, England

[73] Assignee: W & A Bates Limited, London, England

[21] Appl. No.: 310,393

[22] Filed: Oct. 9, 1981

[30] Foreign Application Priority Data

Oct. 16, 1980 [GB] United Kingdom ..... 8033332

[51] Int. Cl.[3] ..... B29H 17/00; B29H 9/04; D04H 3/05

[52] U.S. Cl. ..... 156/117; 156/181; 156/397; 156/405.1; 156/440; 28/101; 152/359; 152/361 R

[58] Field of Search ..... 156/110 R, 117, 397, 156/181, 439–440, 405 P, 405.1; 28/101–102; 152/354–356, 357–359, 361

[56] References Cited

U.S. PATENT DOCUMENTS 3,675,285 7/1972 Atnood et al. ..... 156/440

3,972,767 8/1976 Frazier ..... 156/397

4,249,981 2/1981 Pelletier et al. ..... 156/441

*Primary Examiner*—Edward C. Kimlin

*Assistant Examiner*—Lois E. Boland

*Attorney, Agent, or Firm*—Stevens, Davis, Miller & Mosher

[57] ABSTRACT

Apparatus for and method of manufacturing tire breaker fabric comprising an elongated sheet of parallel closely spaced cords formed from a single cord laid in zig-zag fashion such that the edges of the sheet are formed by a series of folded cord edges. The apparatus comprises a cord laying head for laying a single cord in zig-zag fashion between a pair of spaced-apart edge forming units each comprising a holding pin engageable with a folded cord edge and a pincher head engageable around the pin to crimp the folded cord edge. A collector and holding unit collects the zig-zag cord assembly so formed and is operable to feed each traverse of cord in sequence to a device for applying elastomer to the cord assembly.

25 Claims, 3 Drawing Figures

REINFORCED STRUCTURES

This invention relates to reinforced structures and in particular to apparatus for manufacturing tire tread reinforcement fabric, often known as breaker fabric and to the method of operating said apparatus.

It relates more specifically to a special type of breaker fabric as described in assignee's co-pending U.S. Patent application Ser. No. 283,039 filed July 13, 1981. The breaker fabric there described comprises an elongate sheet of tire cord embedded in rubber, the elongate sheet having edges spaced apart by the width of the breaker ply for which said fabric is intended wherein at least in the edge regions, the tire cord is all in a single plane such that the sheet in said regions is only one cord diameter thick, the cords extending across the sheet to the sheet edges and each portion of each cord at said edge folded on itself about an axis perpendicular to the plane of the sheet such that the edges of the sheet are formed by a series of folded cord edges. The cords are all formed by a single continuous cord which extends back and forth across the sheet being folded back on itself at each edge in turn.

It is important in tire breaker fabric that the cords are very consistently and accurately positioned and an object of the present invention is to provide an apparatus for assembling tire breaker fabric of the required consistency.

According to one aspect of the present invention an apparatus for making tire breaker fabric comprises, in the order set out, a tire cord laying head arranged to lay tire cord in zig-zag formation between a pair of spaced-apart edge forming units, each edge forming unit comprising a loop holding pin extending perpendicular to the cord assembly being made and a pincher head engageable about said holding pin, a collector and holding unit for collecting the zig-zag assembly of cords from the holding pins and means for applying elastomer to the cord assembly.

The pincher heads are each preferably in the form of two co-pending anvils each one of which includes a groove extending parallel to the holding pin and arranged so that the anvils may be closed around the pin to crimp the loop around the pin. Drive means are provided for the anvils to effect closing operation and also to provide for moving the pin out of engagement with the loop and a second subsequent crimping of the loop to a smaller radius. More than one pair of anvils may be provided, the pairs of anvils being mounted in a single turret such that the loop may be initially carried on through the apparatus by one pair of anvils while the next pair indexes onto the holding pin. Preferably there are four pairs of anvils per turret.

The holding pin associated with each edge forming unit may comprise a small diameter rigid pin of, for example, steel. The pin diameter is chosen so as to allow a small bend radius to be formed in the cord to produce the required loop at the edge of the breaker fabric. The pin may be movable along its longitudinal axis so that as the laying head lays the cord the latter is looped beyond the axis of the pin and the pin is then brought upwards to engage the loop. Drive means and synchronization means are provided to effect this cord engagement operation and also to then bring the pin and the cord loop to a pair of anvils for closing and crimping of the loop. Means are also provided to reciprocate the pin in the direction of the movement of the cord assembly through the apparatus so that the pin may bring the loop into the gap between a pair of anvils.

The edge forming units are arranged so that the cord is laid substantially normal to the direction of movement of the cord assembly and at least one edge forming unit is movable towards and away from the other edge forming unit so that successive cord lengths are of different widths and alternate cord lengths are of the same width.

In consequence the centreline of the resultant cord assembly is inclined at an angle relative to the direction of movement of the cord assembly and the collector, elastomer applying means and haul-off are mounted parallel to the centreline of the cord assembly thus formed so that resultant fabric sheet has the transverse cord lengths at the required bias angle, i.e. if the centreline of the cord assembly is at an angle B to the direction of movement thereof the centreline of the cord assembly is at an angle (90−B) to the centreline of the rubberized fabric sheet. Suitable synchronization may be provided between the various moving components by use of a single interlinked drive means.

The zig-zag cord assembly is preferably laid between the edge units on a flat surface or table which may have a cover plate a small distance above it and parallel to it such that the zig-zag cord lay is restricted into the required sheet formation.

The collector unit and holding unit are preferably a continuation of the table and cover plate with cord holding means and cord moving means. The holding and moving means are arranged to hold the cords in the correct parallel equally spaced relationship and to feed them in this regular form to the rubberizer. The holding and moving means may comprise sprocket wheels. Preferably, however, the holding means is an escapement mechanism comprising two parallel rows of cord engaging teeth, each row being parallel to the cord transverse direction, the two rows being spaced apart by a single cord diameter and means is provided to lower one row of teeth at a time so that one cord may be advanced at a time by the moving means which may comprise for steel cord reinforcement a magnetic field provided by magnets below and/or above the laying table. The magnets are positioned at or beyond the entry to the rubberizer and thus feed the cords into the rubberizer in turn.

The rubberizer and haul-off units may be integrated and comprise two or more conveyor belts which engage the upper surface of the breaker fabric to drive it stepwise out of the apparatus moving a step each time a cord is added. Rubber strip feeders are provided to supply strips of unvulcanized rubber into the space between the belts and the top of the cord assembly so that the strips are rolled into the top surface of the cord assembly thus consolidating the assembly into a sheet which may be handled. Further unvulcanized rubber may be applied to complete the rubberizing across the whole sheet in the rubberizer/haul-off area or subsequently.

The tire cord laying head may comprise any cord feed unit capable of laying the required zig-zag but preferably comprises a pair of driven cord feed rollers each rotatably mounted about parallel axes perpendicular to the plane of the fabric being assembled. The cord feed rollers may be mounted on a laying arm which is pivotally mounted at the end remote from the feed rollers such that the feed rollers may be swung from side to side, i.e. from edge unit to edge unit, and thus feed the cord to the required points in the zig-zag. The pair of feed rollers may be mounted in a sub-assembly which itself is rotatable about an axis so that the feed rollers can be made to project or drive the cord output and the sub-assembly is driven in synchronization with the laying arm so as to form an initial loop at each edge of the zig-zag and so as to project the loop beyond the holding pin which is subsequently raised to engage the loop while the laying arm swings back towards the other side. Preferably the cord is fed along the laying arm from a supply reel. To allow for laying at an acute angle across the breaker fabric the nip of the feed rollers may be made such that the cord may be pulled through the rollers by the edge unit holding pin pulling out the additional small extra length when needed. Alternatively a one-way clutch may be provided in the feed roller drive.

Another aspect of the present invention provides a method of manufacture for tire breaker fabric comprising a single continuously laid, zig-zag reinforcing cord which method comprises feeding a single breaker reinforcing cord to a tire cord laying head, laying the cord across the width of the intended fabric, effecting a 180° change of direction at one edge of the fabric being assembled to form a loop with a vertical axis at said edge, bringing a first holding pin into engagement with said loop, engaging a first pin pinching head around the pin to crimp the cord around the pin, returning the cord across the width of the fabric, forming a loop at the other edge of the fabric which is in turn engaged by a second holding pin and a second pinching head, moving the first pin out of engagement with the loop first formed, closing the first pinching head to crimp the loop fully to a small radius, opening the first pinching head to release the first loop, propelling the first cord length across a laying table into a collecting unit and repeating the above steps to form an elongated cord assembly to which a layer of elastomer is subsequently applied to form a fabric sheet.

Preferably cord is made of steel and the propelling of the cord lengths to the collecting unit is effected by means of magnetic attraction. Preferably an escapement mechanism is used to hold a bank of parallel cords, for example four, in a storage zone prior to rubberizing.

Preferably the cord traverses are laid at an acute angle to the fabric being formed, for example 21°, and the rubberizing unit and half-off unit are at an angle to the direction of the laying head traversing movement. The holding pin and pincher head at one side of the fabric being made is moved in the direction of the lay of the cords for alternate cords so that every other cord is longer than the others so that the required acute bias angled fabric is assembled.

Preferably the tire cord laying head is reciprocated from side to side so as to lay the required zig-zag of cord. The laying head itself may be rotated so as to swing the cord outwards in the edge regions to form a loop around the point at which the holding pin is to engage the loop.

Further aspects of the invention will be apparent from the following description, by way of example only, of one embodiment of the present invention in conjunction with the attached diagrammatic drawings in which.

Figure 1:
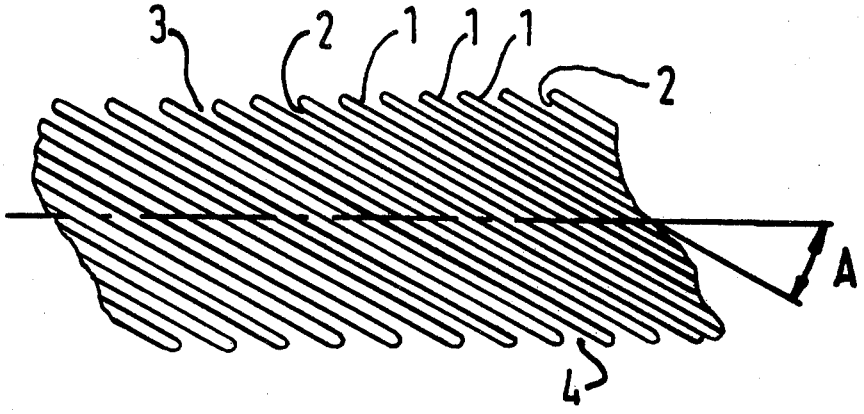
FIGS. 1 and 2 are a plan and edge view respectively of the tire cord fabric manufactured by the apparatus and method of the present invention.
Figure 2:
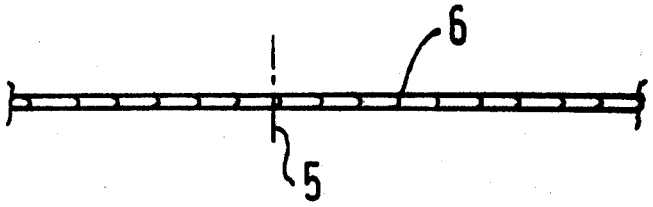

The breaker fabric shown in FIGS. 1 and 2 is an elongated sheet of fabric having parallel, closely-spaced steel wire reinforcement cords 1 and 2 laid at an acute angle A of 21° to the longitudinal centreline of the elongated sheet. It should be noted, however, that the parallel cord assembly comprises a single cord laid in zig-zag fashion such that the cords marked 1 when they reach the edge 3 of the sheet fold back on themselves and follow the cord path marked 2. Similarly at the other edge 4 of the sheet the cords marked 2 fold back on themselves and follow the cord path marked 1. The cord folds form a looped edge construction.

FIG. 2 shows the axis 5 of the fold between adjacent cords to be perpendicular to the main surface areas of the sheet. Thus the sheet at the regions of the edges is only substantially one cord in thickness. The cords are held in the assembled positions by means of unvulcanized rubber compound 6 which is frictioned into the cord assembly by means of a pair of rollers in the same manner as conventional tire cord fabric.

The resultant tire cord fabric sheet is thus the required width for use in tire building, the cords are already at the required bias angle, no cut cord ends exist at the fabric edges and yet the fabric sheet has a substantially uniform thickness which provides further freedom in tire design and building methods.

Figure 3:
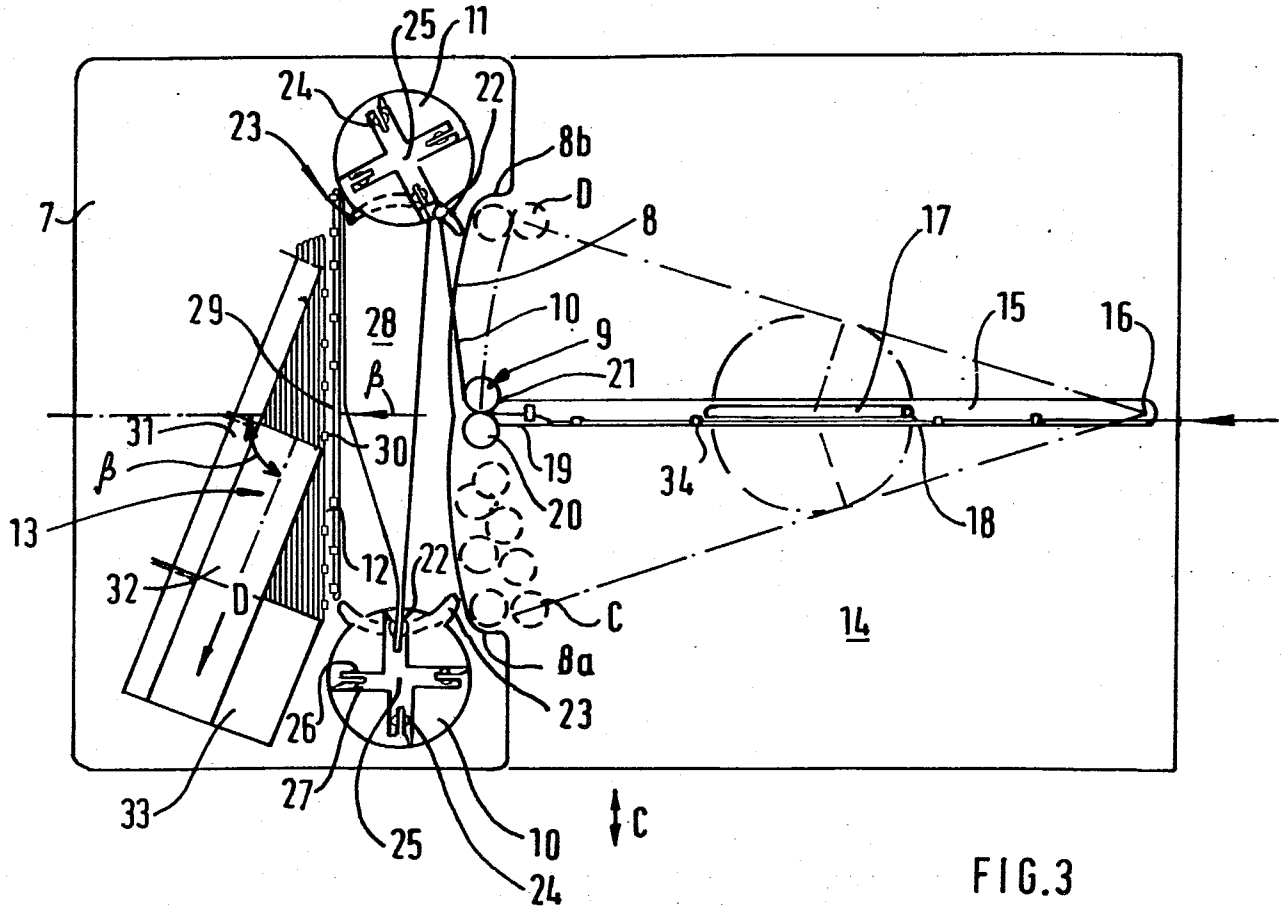
FIG. 3 is a plan layout of the fabric assembly apparatus according to the present invention.

An apparatus for manufacturing the fabric described is shown in FIG. 3 and comprises, in brief, a fabric, non-magnetic laying table 7 which is generally rectangular and has a specially shaped cord receiving edge 8, the shape of which will be described in detail below but which is in general cut away to avoid the swing of a cord laying head 9 which is mounted in the plane of the table 7 so that the cord is projected onto the table. Adjacent to each end 8*a* and 8*b* of the shaped receiving edge is provided an edge unit 10 and 11 respectively which form the fabric edges and generate the zig-zag cord assembly which is passed along the table in the direction of arrow B to a cord collector 12 from which a rubberiser/haul-off unit 13 takes the assembly at an acute angle as required for the breaker fabric to have the required bias angle. The complete apparatus is mounted on a main base plate 14.

The cord laying head comprises a laying arm 15 which is pivotally mounted at one end on a vertical pivot pin 16 and has intermediate its length a slot 17, extending along its centreline, and a drive pin 18 engaging the slot 17. The drive pin 18 is mounted on a rotatable, driven disc such that the laying arm may be moved so that the other end 19 of the laying arm swings to and fro adjacent to and along the cord receiving edge 8 of the table 7. A pair of cord feed rollers 20,21 are mounted at the said end 19 and driven so that they can feed the cord onto the table 7. Guides 34 are provided along the laying arm to guide the cord from a supply creel (not shown) to the feed rollers. The pair of feed rollers 20,21 are themselves mounted on a rotatable head plate (not shown) which is driven in synchronisation with the swing of the laying arm 15 so that the feed rollers 20,21 direct the cord in a varying direction as shown by the ghosted views C D of the feed rollers at the ends of the swing of the laying arm. This rotation or redirection of the feed rollers 20,21 is to improve the zig-zag lay of the cord to allow ready pick up of the edge loops by the two edge units 10,11.

The edge units 10 and 11 are similar and each comprises a holding pin 22 which projects vertically upwards through a curved slot 23 in the table 7. Drive and support means are provided so that the pin 22 may be moved along its axis to project above the plate surface or to move downwards and also so that the pin may be moved around the curved slot 23. Details of the pin movement will be explained later in conjunction with the operation of the apparatus. Each edge unit 10 or 11 also comprises four pincher heads 24 interconnected in a turret which is in the form of a cross and rotatably mounted about a vertical axis 25 through the centre of the cross. Drive means are provided so that each pincher head 24 in turn comes around to its respective pin 22 as will be explained. The pincher units 24 each comprise a pair of co-operating anvils 26 and 27 each having a groove across the face dimensioned so that the anvils 26 and 27 may be driven to close around the pin 22. The edge unit 11 is fixed and the edge unit 10 is movable by a small distance in the direction of the arrow C, towards and away from the edge unit 11 to vary the length of successive cords, the motion again being synchronized to the other motions as will be explained.

The table surface 28 between the two spaced apart edge forming units 10 and 11 acts as a support for the zig-zag cord assembly and a cover sheet (not shown) is provided above the cord assembly to ensure that the zig-zag cord cannot spring upwards out of shape. The cover sheet extends in the direction of arrow B to the input edge of the rubberizer and haul-off unit 13.

The rubberizer and haul-off unit 13 has an input edge 29 which is parallel to the finished laid direction of the cords to which edge 29 the zig-zag cord assembly is presented by a holding and moving means which comprises an escapement mechanism 30. The escapement mechanism 30 is formed by two sets or rows of cord engaging teeth. Each set of teeth is parallel to the input edge 29 and one set is spaced from the other by the diameter of a single cord. Drive means are provided so that in turn each set of teeth may be withdrawn beneath the surface of the table 7 and then raised to engage the next traverse of cord. The two sets of teeth thus provide the cord holding means.

The cord moving means comprises a set of spaced apart magnets (not shown) which are positioned immediately beneath the table 7 and which are positioned so as to attract the steel tire cord across the table 7 towards the input edge 29 of the rubberizer and haul-off unit 13.

The rubberizer and haul-off unit 13 is not shown in detail but comprises three side-by-side endless drive belts 31,32 and 33 positioned above the cord assembly. Each drive belt is arranged to have a lower run in contact with the zig-zag cord assembly such that the drive belts 31,32 and 33 together propel the assembly in the longitudinal direction of the breaker fabric (arrow D). The rubberizing of the assembly is effected by feeding between the cord assembly and each drive belt a thin strip of unvulcanized rubber which is compacted onto the assembly to form a fabric which may be handled. Drive means are also provided for the drive belts 31,32 and 33 which drive means is synchronized to the other drive means for the machine to operate autmatically.

The operation of the machine will now be described by following through the machine a portion of tire cord. The tire cord is pulled through the guides 22 on the laying arm 15 by means of the cord feed rollers 20 and 21 which are driven at constant speed to propel the cord onto the support table 7 in the form of a zig-zag. The laying arm 15 is traversed from side-to-side with simple harmonic motion and the cord feed rollers 20 and 21 are rotated to accentuate the zig-zag laying effect and to produce wide loops at the two sides of the zig-zag.

As each edge loop is propelled onto the table it is engaged by one of the edge units 10,11 by bringing the associated holding pin 22 vertically upwards through the table 7 so as to enter the loop. A pair of anvils carried by the adjacent pincher head 24 is then positioned around the pin 22 and the cord loop and closed to crimp the cord to the pin radius. Meanwhile the feed rollers 20 and 21 are laying the next traverse of cord to the other edge unit, the cord being held at the first edge unit by the pin 22 and pincher head 24. As soon as the other edge unit engages the next loop the first edge unit consolidates its loop by withdrawing the pin 22 downwards and again closing the pincher head 24. The turret 25 rotates to carry the crimped edge loop across the table 7, surface 28, towards the collector unit and the magnets continue the cord movement in the direction of arrow B as the pincher head 24 is opened to release the loop.

The pincher heads 24 are subsequently indexed round on their turrets so that the next pincher head 24 is in place to receive the next edge loop. The pin 22 is also returned to the point at which the next edge loop is to be engaged.

During the laying operation the edge unit 10 is movable in the direction of arrow C towards and away from the fixed edge unit 11 so that alternate lays of the zig-zag are of the same width and successive lays of the zig-zag are of different width. In consequence the centreline of the resultant cord assembly is inclined at an angle $\beta$ to the direction of movement of the cord assembly selected to produce the cord assembly at the required lay angle for the rubberizer.

It should be noted that the combination of a constant feed rate for the cord by the rollers 20,21 and the simple harmonic motion results in the loops being first laid as open loops but subsequently the cord is pulled taut to ensure a straight lay across the fabric.

The traverses of cord are drawn across the table surface 28 by the magnets until they form a stock of 4 or 5 traverses against the first row of cord engaging teeth. The first row is lowered to allow one cord to move, again under the influence of magnetic forces, to engage the second row of teeth and the first row is raised. Then the second row is lowered so that the magnetic forces take a single cord in a straight line into the nip of the haul-off unit 13 which comprises three drive belts 31,32 and 33 arranged side-by-side one another above the table surface 28. Meanwhile the first set of teeth allows a second cord to move up to the second set of teeth. The haul-off unit 13 is driven stepwise as each successive cord is received by it and the three drive belts 31, 32 and 33 roll three strips of rubber veneer into the upper surface of the assembly cords to form a handleable fabric sheet. The drive belts 31,32,33 move in a direction parallel to the centreline of the cord assembly so that the cord lengths are inclined at a bias angle of $(90-B)^\circ$ relative to the longitudinal direction of the rubberized fabric.

Further rubberizing to form a completely rubberized fabric sheet may be effected as convenient prior to batching up the fabric sheet either in a continuous roll or by cutting it into discrete breaker lengths prior to stacking for storage and later usage to produce tires.

The apparatus may be used for various widths of breaker fabric and for different bias angles by adjusting the spacing between the edge forming units 10,11 and the reciprocating movement of edge unit 10 relative to each unit 11.

Alternatives to some parts of the machine are possible while retaining the basic principle of laying the cord between two single spaced apart loop holding pins. For example, the laying head may be on a carriage instead of a laying arm or may indeed be stationary using change in direction of cord projection, rotation of the cord feeding head to lay the zig-zag of cord onto the surface of the table.

Different pincher head arrangements are possible and/or the pincher heads may be used to carry the cord assembly to the rubberizer and haul-off unit. The cord engaging teeth may be replaced by other cord holding means such as for example, toothed wheels where a single cord is held and moved forward by each gap between the teeth. The magnetic system of cord movement is of course particularly useful for steel cord but the apparatus may also be used with non-magnetic materials in which case mechanical cord drive means is substituted. In addition alternative haul-off and rubberizing means may be used.

Having now described my invention, what is claimed is:

1. Apparatus for making a tire breaker fabric comprising an elongate sheet of tire cord fabric embedded in elastomer in which the cords extending across the sheet are formed by one single continuous tire cord which extends back and forth across the sheet so that the edges of the sheet are formed by a series of folded cord edges, the apparatus comprising:

(a) a pair of spaced apart edge forming units;

(b) a tire cord laying head for laying one single continuous tire cord in zig-zag formation between said edge forming units;

(c) said tire cord laying head having means to impart a loop to the tire cord at each edge forming unit;

(d) each edge forming unit having one loop holding pin engageable with said looped cord and a pincher head engageable about said holding pin to crimp said looped cord and the pin to form a folded cord edge;

(e) means for releasing each folded cord edge from the associated loop holding pin and transferring the cord extending between the edge forming units to a collector and holding unit to form a cord assembly comprising a plurality of cords the edges of which are formed by folded cord edges;

(f) said collector and holding unit being operable to release the cords of said cord assembly individually; and (g) means for advancing each released cord to means for applying elastomer to the cord to produce tire breaker fabric.

2. Apparatus according to claim 1 wherein each edge forming unit comprises at least one pair of relatively movable anvils.

3. Apparatus according to claim 2 wherein each pair of anvils defines a groove extending parallel to the associated pin.

4. Apparatus according to claim 2 wherein each edge forming unit comprises a plurality of pairs of anvils.

5. Apparatus according to claim 4 wherein said pairs of anvils are rotatable about a common axis so as to engage the associated holding pin in sequence.

6. Apparatus according to claim 5 wherein said pairs of anvils are mounted in a single turret.

7. Apparatus according to claim 1 wherein each holding pin is movable in the direction of its length.

8. Apparatus according to claim 1 wherein each holding pin is mounted for reciprocating movement in the direction of movement of the cord assembly.

9. Apparatus according to claim 8 wherein said reciprocating movement follows an arcuate path.

10. Apparatus according to claim 1 wherein said edge forming units are arranged so that the cord is laid normal to the direction of movement of the cord assembly.

11. Apparatus according to claim 10 wherein at least one edge forming unit is movable towards and away from the other edge unit during the laying operation whereby the centreline of the cord assembly so produced is inclined relative to the direction of movement of the cord assembly.

12. Apparatus according to claim 1 including means to adjust the initial spacing between said edge forming units to produce a cord assembly of the required width.

13. Apparatus according to claim 1 wherein the collector unit and holding unit comprise a flat surface on which the cord assembly is laid with cord holding means.

14. Apparatus according to claim 13 wherein said cord holding means comprises two parallel rows of cord engagement teeth spaced apart by a single cord diameter and operable to release the cord assembly one cord at a time.

15. Apparatus according to claim 1 wherein the cord assembly is formed of steel and said advancing means comprises a magnetic field provided by magnets positioned above or below the cord assembly.

16. Apparatus according to claim 1 wherein said elastomer applying means comprises at least one endless belt arranged to feed a layer of unvulcanized rubber between said belt and a confronting surface of the cord assembly.

17. Apparatus according to claim 16 wherein said belt is advanced in a direction parallel to the centreline of the cord assembly.

18. Apparatus according to claim 1 including a haul-off unit downstream of the elastomer applying means.

19. Apparatus according to claim 1 wherein said laying head comprises a pair of driven feed rollers each rotatably mounted about parallel axes perpendicular to the plane of the cord assembly.

20. Apparatus according to claim 19 wherein said laying head is mounted for side-to-side movement between said edge forming units.

21. Apparatus according to claim 20 wherein said laying head is carried by a laying arm pivotally mounted about an axis perpendicular to the plane of the cord assembly.

22. Apparatus according to claim 20 wherein said laying head is mounted for reciprocating movement on a carriage extending between said edge forming units.

23. Apparatus according to claim 19 wherein said feed rollers are mounted in a sub-assembly rotatable about an axis perpendicular to the plane of the cord assembly.

24. A method of manufacture for tire breaker fabric comprising a single continuously laid, zig-zag reinforcing cord, the method comprising:

feeding a single breaker reinforcing cord to a tire cord laying head;

laying said tire cord across the width of the intended fabric;

effecting a 180° change of direction at one edge of the fabric being assembled to form a loop with a vertical axis at said edge;

bringing a first holding pin into engagement with said loop;

engaging a first pin pinching head around said pin to crimp said cord around said pin;

returning said cord across the width of the fabric;

forming a loop at the other edge of the fabric which is in turn engaged by a second holding pin and a second pinching head;

moving said first pin out of engagement with said first loop;

closing said first pinching head to crimp said first loop fully to a small radius;

opening said first pinching head to release said first loop;

propelling the first cord length across a laying table into a collecting unit and repeating the above steps to form an elongated cord assembly releasing the cords of said cord assembly individually and advancing each released cord to elastomer applying means to form a fabric sheet.

25. A method according to claim 24 wherein said cord is made of steel and the propelling of the cord lengths to said collecting unit is effected by means of magnetic attraction.

* * * * *